US008807939B2

(12) United States Patent
Gardas

(10) Patent No.: US 8,807,939 B2
(45) Date of Patent: Aug. 19, 2014

(54) SYSTEM FOR ADJUSTING CHARACTERISTICS OF A FAN

(75) Inventor: Ravindra Gardas, Solapur (IN)

(73) Assignee: General Electric Company, Schenectady, NY (US)

( * ) Notice: Subject to any disclaimer, the term of this patent is extended or adjusted under 35 U.S.C. 154(b) by 696 days.

(21) Appl. No.: 13/161,430

(22) Filed: Jun. 15, 2011

(65) Prior Publication Data

US 2012/0321475 A1 Dec. 20, 2012

(51) Int. Cl.

| | |
|---|---|
| ***F03B 3/14*** | (2006.01) |
| ***F04D 29/36*** | (2006.01) |
| ***F04D 29/64*** | (2006.01) |

(52) U.S. Cl.

CPC ..... *F04D 29/36* (2013.01); *F04D 29/646* (2013.01)

USPC ..... 416/89; 416/147; 416/205

(58) Field of Classification Search

USPC ..... 416/205, 87, 153, 201 R, 204 R, 207, 416/219 R, 132 R, 134 R, 135, 130, 248, 416/147, 89; 415/130, 912

See application file for complete search history.

(56) References Cited

U.S. PATENT DOCUMENTS

2006/0280608 A1* 12/2006 McCallum et al. ..... 416/112

* cited by examiner

*Primary Examiner* — Edward Look
*Assistant Examiner* — Aaron R Eastman
(74) *Attorney, Agent, or Firm* — Fletcher Yoder, P.C.

(57) ABSTRACT

An adjustable fan with a rotary hub capable of supporting rotary blades in a plurality of orientations relative to a rotational axis of the fan.

16 Claims, 6 Drawing Sheets

SYSTEM FOR ADJUSTING CHARACTERISTICS OF A FAN

BACKGROUND OF THE INVENTION

The disclosed subject matter relates to fans, such as fans used for cooling various equipment.

A variety of industries and products employ fans to move a gas, such as air, from one location to another. For example, fans may be used for cooling electronics, machinery, heat exchangers, combustion engines, electric motors, and a variety of other equipment. Fans also may be used for ventilation or air quality control, such as ventilating buildings, work areas, or the like. As appreciated, each application may require a different flow rate, pressure, noise level, or other characteristic. Furthermore, each application may have different constraints, such as dimensions (e.g., length, width, and depth of the fan). As a result, each fan typically has a fixed size and arrangement of fan blades, which provide a fixed set of operating parameters. As the National Electrical Manufacturers Association (NEMA) and the International Electrotechnical Commission (IEC) vary the standards relating to fans, new fans must be produced to satisfy these new standards. Accordingly, a need exists to adjust fans to accommodate different standards and application requirements.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a fan having a rotary blade and a rotary hub. The rotary hub has a variable orientation mount configured to support the rotary blade in a plurality of orientations relative to a rotational axis of the fan.

In a second embodiment, a system includes a fan hub having an adjustable blade mounting system. The adjustable blade mounting system has a plurality of variable orientation mounts configured to support a plurality of rotary blades about a circumference of the fan hub. Each mount of the plurality of variable orientation mounts is configured to support a respective rotary blade in a plurality of heights or a plurality of angles.

In a third embodiment, a system includes an adjustable fan blade having a blade portion and a first rail mount portion. The first rail mount portion is configured to mount with a second rail mount portion or a third rail mount portion of a fan hub in a plurality of heights or a plurality of angles relative to a rotational axis of the fan hub.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
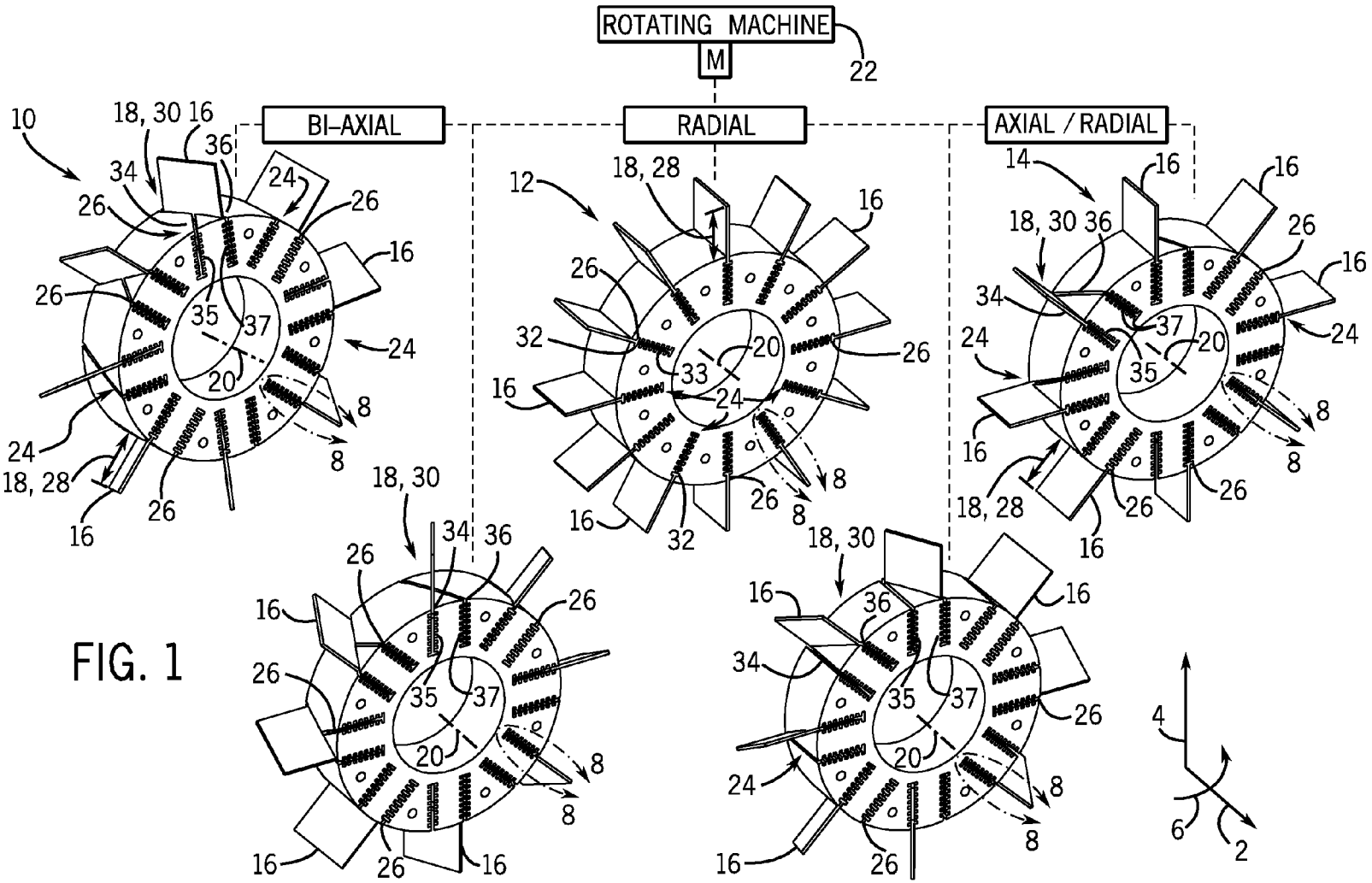
FIG. 1 is a diagram illustrating embodiments of a bi-axial, radial, and axial/radial fan hub with rotary blades installed in variable orientations.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed further below, the disclosed embodiments include a fan system with a rotary hub that includes a blade mounting system for adjustable mounting of fan blades. The blade mounting system may enable the fan blade properties to be adjusted for various standards or application requirements, thereby enabling a single fan to be adapted for multiple applications. For example, the blade mounting system may enable adjustment of the height, angle, number, spacing, or any combination thereof, of the blades relative to the rotary hub. In certain embodiments, the blade mounting system may include a plurality of variable orientation mounts disposed about the circumference of the hub, wherein each variable orientation mount includes a plurality of selectable mounting heights and/or a plurality of selectable mounting angles. For example, each variable orientation mount may include at least one mounting slot having a plurality of selectable mounting heights, such as a plurality of grooves, protrusions, inserts, or other height locking features, which mate with a base of the fan blade to secure the fan blade at a particular height. By further example, each variable orientation mount may include a plurality of mounting slots, such as first and second mounting slots, which may be oriented at different angles to secure the fan blades at different angles. Accordingly, the disclosed embodiments enable adjustment of the angle and height of the fan blades, such that the fan may be configured for an axial flow, a reverse axial flow, or a radial flow. Furthermore, the disclosed embodiments enable adjustment of the fan blades to change the mass flow rate, pressure, flow direction, and outer diameter of the fan. The number and/or spacing of the blades also may be adjusted by adding or removing fan blades from certain variable orientation mounts. The following discussion refers to FIGS. 1-16 to describe features of various embodiments of fans with variable blade mounting, but is not intended to be limited to the illustrated embodiments.

Turning now to the drawings, FIG. 1 is a diagram of an embodiment of a system or family of adjustable fans that may employ a bi-axial hub 10, a radial hub 12, or an axial/radial hub 14 with rotary blades 16 installed in variable orientations 18 (e.g., heights and/or angles) relative to a rotational axis 20 of the hubs 10, 12, 14. In the discussion of FIG. 1 and the following figures, reference may be made to an axial direction 2 along the rotational axis 20, a radial direction 4 extending away from the rotational axis 20, and a circumferential direction 6 extending around the rotational axis 20 of the hub 10, 12, 14. The system disclosed herein may include a rotating machine 202 capable of turning the rotary hub 10, 12, 14 about the axis 20 in the circumferential direction 6. Each rotary hub 10, 12, 14 includes an adjustable blade mounting system 24 made up of a plurality of variable orientation mounts 26 disposed about the circumference of the respective rotary hub 10, 12, 14. The variable orientation mounts 26 are configured to support rotary blades 16 in a plurality of variable orientations 18 (e.g., heights and/or angles) relative to the rotational axis 20 of the fan hubs 10, 12, 14. For example, the variable orientation mounts 26 may be configured to enable a plurality of heights 28 and/or angles 30 of the rotary blades 16 installed in the hubs 10, 12, 14 relative to the rotational axis 20 of the fan hubs 10, 12, 14.

In the illustrated embodiment of the adjustable blade mounting system 24, the variable orientation mounts 26 may enable changes in the heights 28 and/or angles 30 of the blades 16 to adjust the flow rate, flow direction, pressure, noise level, or any combination thereof. For example, variable heights 28 enable the fan diameter to change, while variable blade angles 30 may enable a change in mass flow rate or flow direction of the fan. Furthermore, the blade mounting system 24 may enable changes in the spacing or number of blades 16 by selectively using some or all of the variable orientation mounts 26 in the circumferential direction 6 about the hub 10, 12, 14. For example, the blade mounting system 24 may selectively install blades 16 at every circumferential location, every other circumferential location, or any other configuration. The variable spacing and/or number of blades 16 achieved with the blade mounting system 24 may be used alone or in combination with the changes in heights 28 and/or angles 30 via the variable orientation mounts 26.

In some embodiments, each variable orientation mount 26 include a single mounting slot 32 with a plurality of height adjustments 33, such as illustrated in the radial hub 12. In other words, each variable orientation mount 26 may be disposed at a non-adjustable angle relative to the rotational axis 20. In other embodiments, each variable orientation mount 26 may provide mutually exclusive mounting angles 30. For example, each variable orientation mount 26 may include a plurality of mutually exclusive mounting slots, such as first and second mounting slots 34, 36, as illustrated in the bi-axial hub 10 and the axial/radial hub 14. In the multi-slot configuration (e.g., slots 34, 36) of the hubs 10, 14, each variable orientation mount 26 is capable of mounting the blades 16 at multiple different angles 30. However, the illustrated slots 34, 36 partially overlap or cross over one another, such that blades 16 cannot be installed in both slots 34, 36 at the same time. In other embodiments, the slots 34, 36 may not overlap one another, and thus may not be mutually exclusive. Furthermore, the first mounting slot 34 includes a plurality of height adjustments 35, and the second mounting slot 36 includes a plurality of height adjustments 37. Thus, the hubs 10, 14 provide both adjustability in the heights 28 and angles 30 of the blades 16.

In the illustrated embodiment of the bi-axial hub 10, the first and second mounting slots 34, 36 are angled different from one another, and are non-parallel to the rotational axis 20. Furthermore, the first and second mounting slots 34, 36 of the hub 10 are inversely angled relative to the axis 20, such that the slots 34, 36 support the blades in inverse angles to reverse the flow direction (e.g., bi-axial flow directions). As a result, if the blades 16 are mounted in the slots 34, then the flow may be directed in a first axial direction 2. On the other hand, if the blades 16 are mounted in the slots 36, then the flow may be directed in a second axial direction 2 opposite from the first axial direction 2.

Similarly, in the illustrated embodiment of the axial/radial hub 14, the first and second mounting slots 34, 36 are angled different from one another, while at least one of the slots 34, 36 is substantially parallel to the rotational axis 20. For example, the illustrated slots 34 are substantially parallel to the rotational axis 20, while the slots 36 are non-parallel to the rotational axis 20. As a result, if the blades 16 are mounted in the slots 34, then the flow may be directed in the radial direction 4. On the other hand, if the blades 16 are mounted in the slots 36, then the flow may be directed in an axial direction 2.

In other embodiments, the first and second mounting slots 34, 36 are both non-parallel to the rotational axis 20, while the slots 34, 36 are angled different from one another. For example, the slots 34, 36 may be configured to provide a variable angle or pitch in the same axial flow direction 2. Accordingly, the slots 34, 36 may be angled away from the rotational axis 20 on the same side of the axis 20. In certain embodiments, the angles of the slots 34, 36 may range between approximately 0 to 90, 5 to 60, or 10 to 45 degrees relative to the axis 20. Furthermore, the slots 34, 36 may be angled at least approximately 5 to 90, 5 to 60 or 5 to 45, or 5 to 30 degrees different from one another, i.e., angle between the slots 34, 36.

Figure 2:
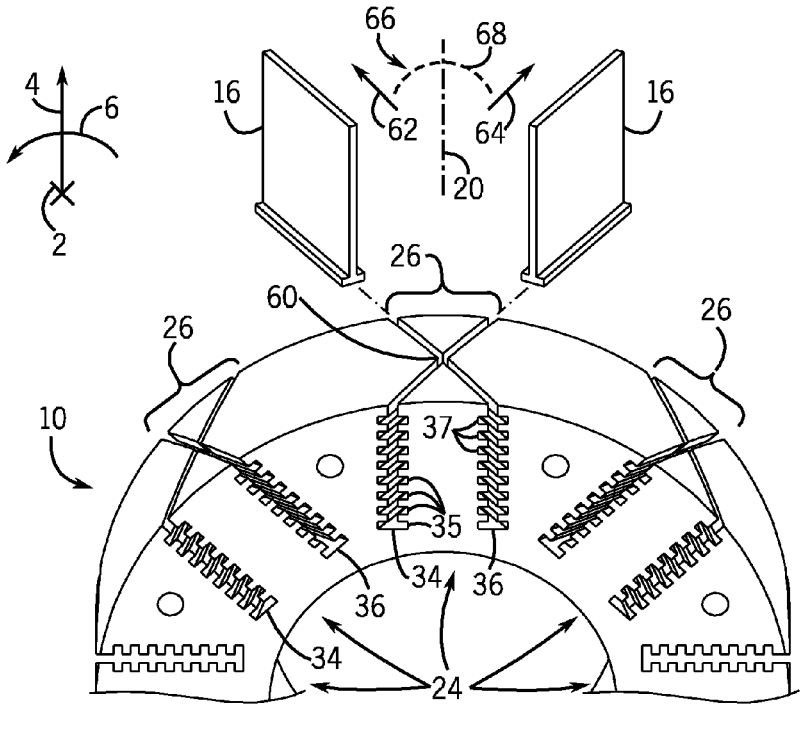
FIG. 2 is a partial perspective view of an embodiment of a bi-axial fan hub with installable fan blades.

FIG. 2 is a partial perspective view of an embodiment of the bi-axial fan hub 10 of FIG. 1, illustrating rotary blades 16 exploded from the first and second mounting slots 34, 36 of one of the variable orientation mounts 26. In the illustrated embodiment, each variable orientation mount 26 in the hub 10 has the first and second mounting slots 34, 36 intersecting in an X-shaped configuration 60. The X-shaped configuration 60 enables the fan blades 16 to be mutually exclusively installed in inversely angled or reversible directions 62, 64, at respective angles 66 and 68 relative to the rotational axis 20. In certain embodiments, the angles 66 and 68 may be substantially the same as one another, and may range between approximately 0 to 60, 0 to 45, 0 to 30, or 0 to 15 degrees. For example, the angles 66 and 68 may be approximately 5, 10, 15, 20, 25, 30, 35, 40, or 45 degrees. In other embodiments, the angles 66 and 68 may be different from one another, but may have angles in the ranges presented above. Furthermore, if the angles 66 and 68 differ from one another, then the angles may differ by approximately 5 to 50, 5 to 25, or 5 to 10 degrees. As a result of the X-shaped configuration 60, the hub 10 may remain fixed to the rotating machine 22, while the blades 16 are changed from the first mounting slot 34 to the second mounting slot 36, or vice versa. The rotating machine 22 also may remain in a fixed position in a particular support structure, equipment, duct, or the like. In this manner, the axial flow direction may be easily reversed solely by reversing the blade 16 positions in the slots 34, 36. Although FIG. 2 illustrates the slots 34, 36 intersecting in the X-shaped configuration 60, other embodiments may intersect two or more slots in other configurations. For example, as discussed below with reference to FIGS. 4 and 5, the first and second mounting slots 34, 36 may intersect in a V-shaped configuration. Furthermore, as discussed in further detail below with reference to FIGS. 8-13, each variable orientation mounts 26 may selectively enable a plurality of heights for the rotary blades 16 installed in the fan hub 12. For example, each mounting slot 34 includes a plurality of height adjustments 35, while each mounting slot 36 includes a plurality of height adjustments 37, such that each blades 16 may be mounted at a plurality of heights in the radial direction 4 relative to the hub 12.

Figure 3:
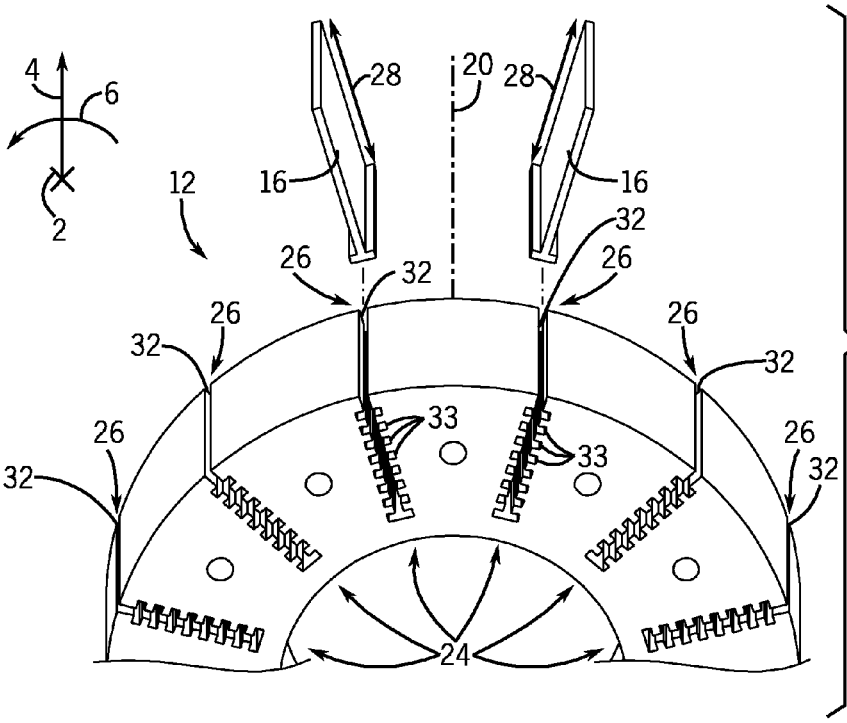
FIG. 3 is a partial perspective view of an embodiment of a radial fan hub with installable fan blades.

FIG. 3 is a partial perspective view of an embodiment of the radial fan hub 12 of FIG. 1, illustrating rotary blades 16 exploded from the mounting slots 34, 36 of two of the variable orientation mounts 26. In the illustrated embodiment, each variable orientation mount 26 in the hub 12 has a single mounting slot 32 oriented substantially parallel to the rotational axis 20, thereby creating a radial flow configuration for mounting of the fan blades 16. As a result, the mounting slots 32 of the hub 12 do not provide any angle or pitch of the blades 12 relative to the axis 20. However, as discussed in detail below, each variable orientation mounts 26 may selectively enable a plurality of heights for the rotary blades 16 installed in the fan hub 12. For example, each mounting slot 32 includes a plurality of height adjustments 33, such that each blades 16 may be mounted at a plurality of heights in the radial direction 4 relative to the hub 12. Additionally, the variable orientation mounts 26 selectively enable a variable number of rotary blades 16 to be installed in the fan hub 12. For example, the blades 16 may be selectively mounted in all or only some of the mounting slots 32 to change the number and spacing of the blades 16.

Figure 4:
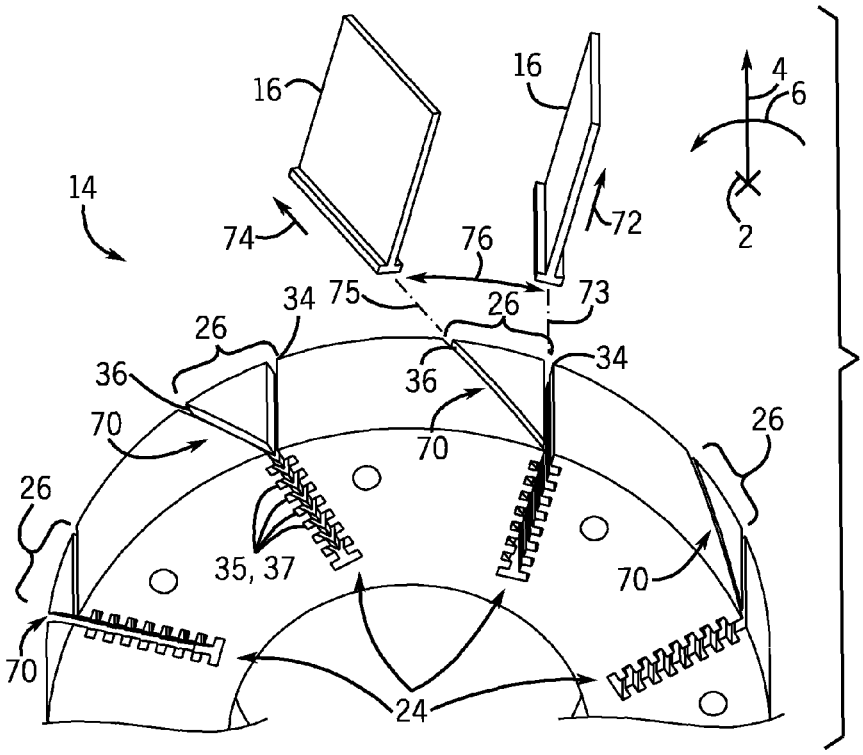
FIG. 4 is a partial perspective view of an embodiment of an axial/radial fan hub with installable fan blades.

FIG. 4 is a partial perspective view of an embodiment of the axial/radial fan hub 14 of FIG. 1, illustrating rotary blades 16 exploded from the first and second mounting slots 34, 36 of one of the variable orientation mounts 26. The first and second mounting slots 34, 36 are configured to selectively modify the hub 14 between an axial flow configuration and a radial flow configuration. In other words, the radial flow configuration defines the hub 14 as a radial flow fan (i.e., flow in the radial direction 4), whereas the axial flow configuration defines the hub 14 as an axial flow fan (i.e., flow in the axial direction 2). Thus, the illustrated hub 14 may be described as a hybrid hub, as it enables operation of the hub 14 as two different fan types (i.e., axial and radial).

In the illustrated embodiment, each variable orientation mount 26 in the hub 14 has the first and second mounting slots 34, 36 intersecting in a V-shaped configuration 70. The V-shaped configuration 70 enables the fan blades 16 to be mutually exclusively installed in different directions 72, 74, at an angle 76 relative to one another. For example, the first direction 72 of the first mounting slot 34 may extend along an axis 73, while the second direction 74 of the second mounting slot 36 may extend along an axis 75. In the illustrated embodiment, the first axis 73 may be substantially parallel to the rotational axis 20 in the axial direction 2, while the second axis 75 is angled away from the rotational axis 20. In other embodiments, as discussed below with reference to FIG. 5, both of the mounting slots 34, 36 may be angled away from the rotational axis 20 on the same side of the axis 20. As illustrated, the axes 73, 75 of the mounting slots 34, 36 are angled away from one another by the angle 76, which may be approximately 0 to 60, 0 to 45, 0 to 30, or 0 to 15 degrees. For example, the angle 76 may be approximately 5, 10, 15, 20, 25, 30, 35, 40, or 45 degrees. As a result of the V-shaped configuration 70, the hub 14 may remain fixed to the rotating machine 22, while the blades 16 are changed from the first mounting slot 34 to the second mounting slot 36, or vice versa. The rotating machine 22 also may remain in a fixed position in a particular support structure, equipment, duct, or the like. In this manner, the flow direction may be easily changed between a radial flow direction 4 with blades 16 in the slots 34 and an axial flow direction 2 with blades 16 in the slots 36 solely by reversing the blade 16 positions.

While the rotary blades 16 are installed in the second mounting slots 36, the fan hub 14 is configured as an axial fan hub. In this configuration, the axial flow direction 2 may be selectively reversed by removing the hub 14 from the fan rotating machine 22, reversing the orientation of the hub 14, and then reinstalling the hub 14 onto the fan rotating machine 22. As a result, the illustrated hub 14 is capable of changing the fan configuration between a radial fan configuration, an axial fan configuration in a first axial flow direction, and an axial fan configuration in a second axial flow direction opposite from the first axial flow direction.

Figure 5:
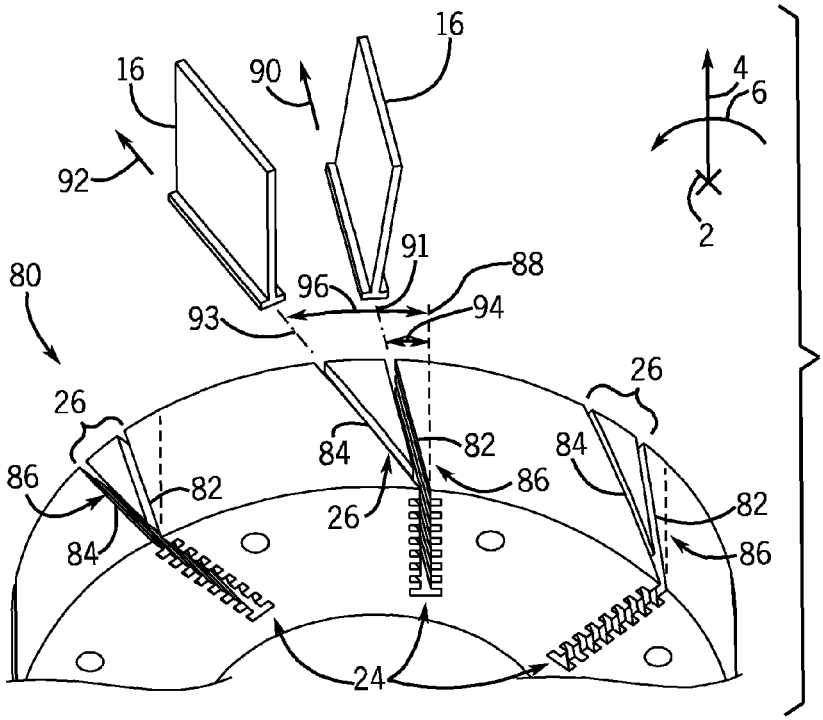
FIG. 5 is a partial perspective view of an embodiment of a bi-axial fan hub, similar to the bi-axial fan hub of FIG. 2, but with installable angles that do not change the direction of the fan blades.

FIG. 5 is a partial perspective view of an embodiment of a fan hub 80, illustrating rotary blades 16 exploded from the first and second mounting slots 82, 84 of one of the variable orientation mounts 26. The mounting slots 82, 84 are configured to selectively modify the hub 80 between a first axial flow configuration and a second axial flow configuration. In the illustrated embodiment, each variable orientation mount 26 in the hub 80 has the first and second mounting slots 82, 84 intersecting in a V-shaped configuration 86, which is angled away from an axis 88 parallel to the rotational axis 20. The V-shaped configuration 86 enables the fan blades 16 to be mutually exclusively installed in different directions 90, 92, at angle relative to one another and the axis 88, thereby defining the first and second axial flow configurations. For example, the first direction 90 (e.g., first axial flow configuration) of the first mounting slot 82 may extend along an axis 91, while the second direction 92 (e.g., second axial flow configuration) of the second mounting slot 84 may extend along an axis 93. As illustrated, the first axis 91 is disposed at an angle 94 relative to the axis 88, while the second axis 93 is disposed at an angle 96 relative to the axis 88 on the same side of the axis 88. The angle 94 may range between approximately 0 to 45, 0 to 30, or 0 to 15 degrees. The angle 96 may range between approximately 0 to 60, 0 to 45, or 0 to 30 degrees. Furthermore, the difference between the angles 94 and 96 may be approximately 0 to 45, 0 to 30, or 0 to 15 degrees. For example, the difference between the angles 94 and 96 may be approximately 5, 10, 15, 20, 25, 30, 35, 40, or 45 degrees.

As a result of the V-shaped configuration 86, the hub 80 may remain fixed to the rotating machine 22, while the blades 16 are changed from the first mounting slot 82 to the second mounting slot 84, or vice versa. The rotating machine 22 also may remain in a fixed position in a particular support structure, equipment, duct, or the like. In this manner, the axial flow configuration may be easily changed by reversing the blade 16 positions. By changing the angle 94, 96, the hub 80 may be reconfigured to increase or decrease the mass flow rate, pressure, noise, or other characteristic of the fan, while maintaining the fan as an axial fan with flow in the same axial flow direction 2.

Figure 6:
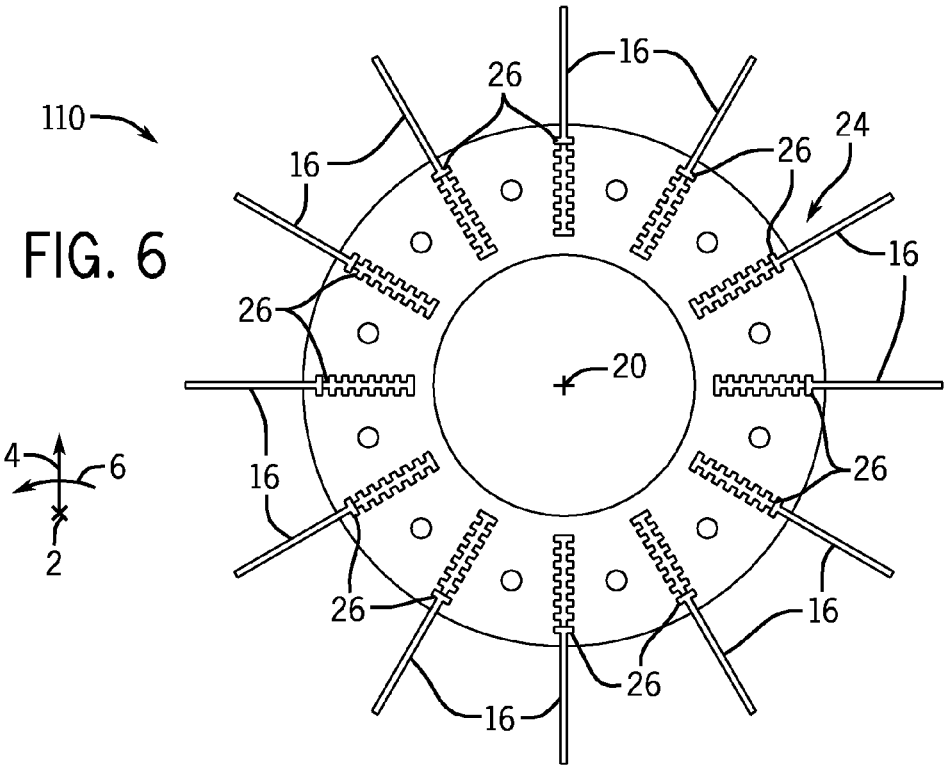
FIG. 6 is a schematic side view of an embodiment of a fan hub with fan blades in each installed at each installable location about a circumference of the fan hub.
Figure 7:
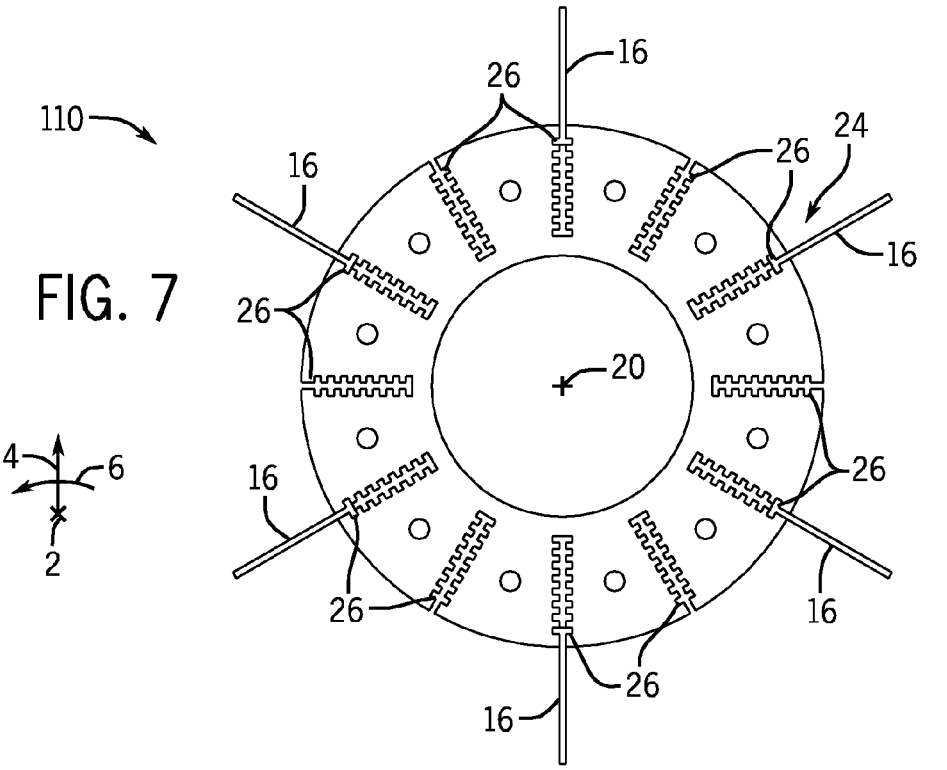
FIG. 7 is a schematic side view of an embodiment of a fan blades installed at every other installable location about the circumference of the fan hub, which shows a reduction in the number of blades with reference to FIG. 6.

FIGS. 6-7 illustrate a fan hub 110 with installed rotary blades 16. FIG. 6 illustrates that a maximum number of fan blades may be determined by the number of variable orientation mounts 26 included in the fan hub 110. In this embodiment, the rotary hub 110 includes twelve variable orientation mounts 26, and thus the fan hub 110 may include a maximum of twelve rotary blades 16. The rotary blades 16 may be selectively installed or removed. For example, FIG. 7 depicts the fan hub 110 of FIG. 6 selectively configured to include only six rotary blades 16. As a result, blades 16 are installed in every other variable orientation mount 26 in the embodiment of FIG. 7. In this manner, the circumferential spacing between blades 16 in FIG. 7 is double the circumferential spacing between blades 16 in FIG. 6. In other embodiments, the number of rotary blades 16 selectively installed in the system could increase or decrease. For example, the blades 16 may be installed in only four equally spaced variable orientation mounts 26, resulting in a circumferential spacing that is three times the spacing of FIG. 6.

Figure 8:
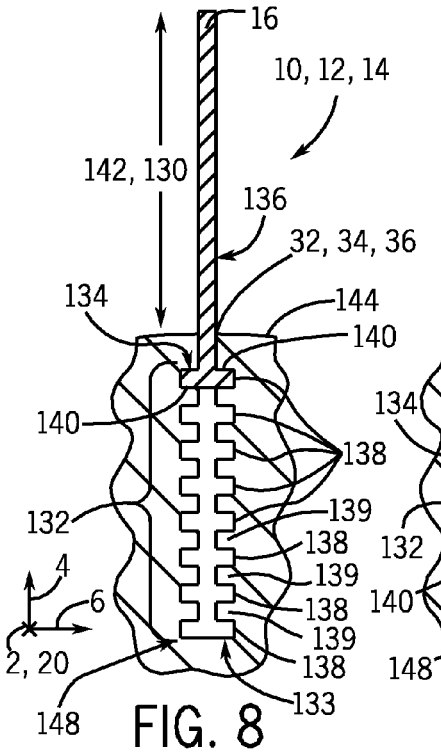
FIGS. 8-10 are partial side views taken within line 8-8 of FIG. 1, illustrating that the fan blade height may be adjusted by installing the fan blades into alternative grooves in the fan hub.
Figure 9:
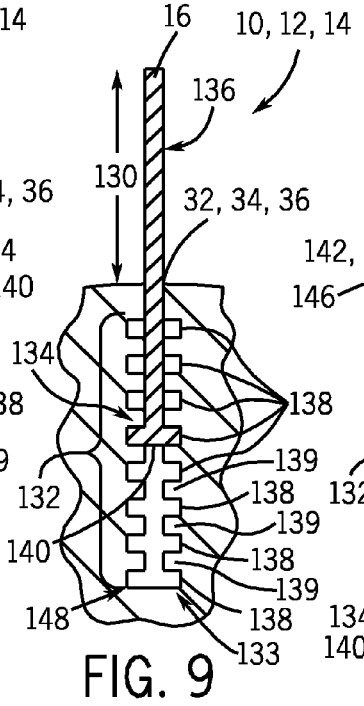
Figure 10:
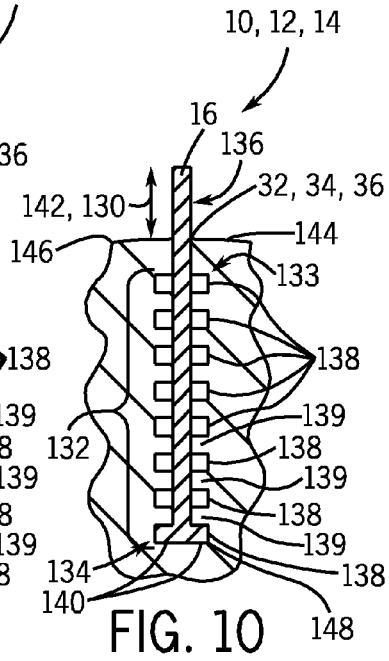

FIGS. 8-10 depict partial side views taken within line 8-8 of FIG. 1, illustrating adjustment of the rotary blade height 130 by installing the rotary blades 16 into a height adjustment feature 132 in the mounting slots 32, 34, 36 of the fan hub 10, 12, 14. In the depicted embodiments, the rotary blade 16 includes a T-shaped base portion 134 and a blade portion 136 extending from the T-shaped base portion 134. The height adjustment feature 132 may selectively support the T-shaped base portion 136 at a plurality of heights. For example, the embodiments of FIGS. 8-10 depict the height adjustment feature 132 as a ribbed slot 133 with lateral grooves 138 at different heights relative to the rotational axis 20. The lateral grooves 138 are spaced apart from one another by intermediate lips, prongs, ledges, or spacers 139. In the illustrated embodiment, the lateral grooves 138 are equally spaced apart from one another by the spacers 139. Furthermore, the lateral grooves 138 and spacers 139 are disposed on opposite sides of the mounting slots 32, 34, 36. While the current embodiments depict a T-shaped base portion 134 of the rotary blade 16, the base portion 134 may include any shape providing at least one lateral lip 140 (e.g., one or two lateral lips 140). The lateral grooves 138 are configured to receive the lateral lips 140 of the T-shaped base portion 134 to selectively lock the blade 16 at different blade heights 130 in the radial direction 4. In the illustrated embodiment, the height adjustment feature 132 includes eight height positions corresponding to the lateral grooves 138 on opposite sides of the mounting slots 32, 34, 36. In other embodiments, the height adjustment feature 132 may include 2 to 50, 2 to 25, 2 to 15, or any other number of height positions corresponding to the lateral grooves 138.

FIG. 8 illustrates a rotary blade 16 selectively installed at a maximum rotary blade height 130, 142. The maximum rotary height 130, 142 may be obtained by installing the base portion 134 of the rotary blade 16 in the position closest to the exterior surface 144 of the fan hub 10, 12, 14. The rotary blade height 130 decreases as the base portion 134 of the rotary blade 16 is selectively installed closer to the rotational axis 20 of the fan hub 10, 12, 14. For example, FIG. 9 illustrates the rotary blade base portion 134 selectively installed three grooves closer to the rotational axis 20 of the fan hub 10, 12, 14, causing the rotary blade height 130 to decrease. In the current embodiment, the minimum rotary blade height 146 may be obtained by installing the rotary blade 16 in the groove 148 closest to the rotational axis 20 of the fan hub 10, 12, 14. For example, FIG. 10 illustrates the rotary blade 16 selectively installed in the groove 148 closest to the rotational axis 20, causing the rotary blade 16 to be configured with the minimum blade height 146.

Figure 11:
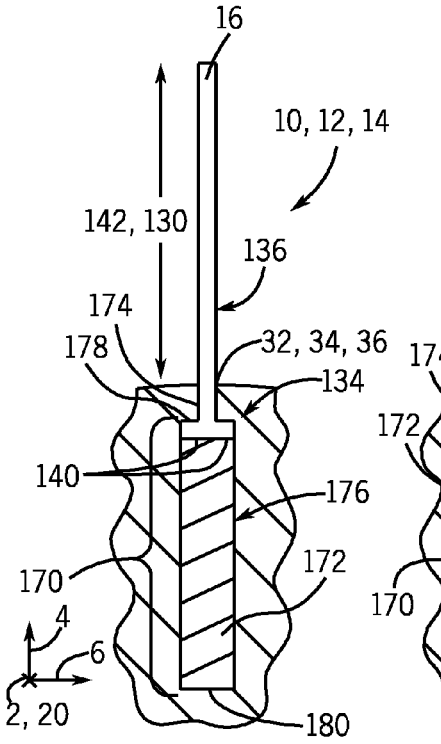
FIGS. 11-13 illustrate an alternative embodiment of the height adjustment system of FIGS. 8-10, providing a single enlarged slot to hold the base portion of the blade and securing the base portion in place with spacers.
Figure 12:
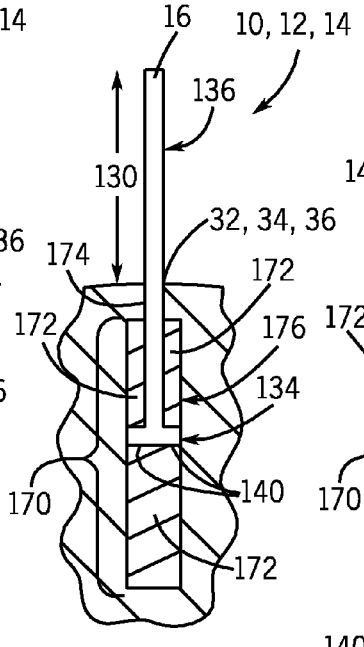
Figure 13:
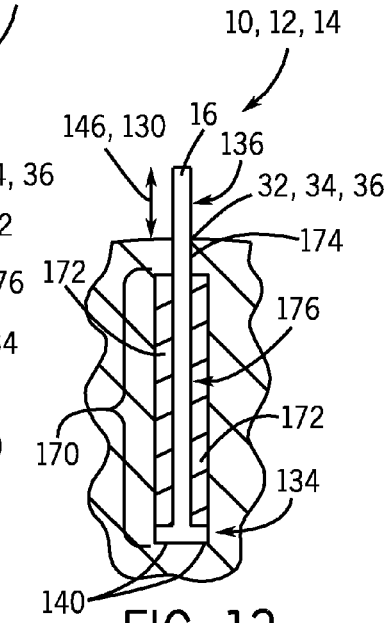

FIGS. 11-13 illustrate an alternative embodiment of the height adjustment system of FIGS. 8-10, providing an expanding volume 170 and spacers 172 configured to lock the rotary blade 16 in place. In this embodiment, the expanding volume 170 of each mounting slot 32, 34, 36 includes an opening portion 174 and an enlarged interior portion 176. As previously described, the rotary blades 16 include the blade portion 136 and the T-shaped base portion 134, which includes opposite lateral lips 140. The blade portion 136 of the rotary blades 16 extends into the mounting slot 32, 34, 36 through the opening portion 174. The T-shaped base portion 134 is selectively secured at a plurality of heights via one or more spacers 172 in the enlarged interior portion 176. As illustrated in FIG. 11, the maximum blade height 142 may be obtained by selectively installing the T-shaped base portion 134 at a neck or transition 178 of the opening portion 174 into the enlarged interior portion 176. One or more spacers 172 fill the remaining void of the enlarged interior portion 176 between the bottom of the T-shaped base portion 134 and a bottom 180 of the enlarged interior portion 176. The height 130 of the blade portion 136 decreases as the T-shaped base portion 134 is selectively installed closer to the bottom 180 of the enlarged interior portion 176. For example, FIG. 12 illustrates the blade height 130 being less than the height 130, 142 of FIG. 11, because the T-shaped base portion 134 of the blade 16 is mounted intermediate the neck 178 and the bottom 180 of the enlarged interior portion 176. The minimum rotary blade height 146 is obtained by selectively installing the T-shaped base portion 134 of the blade 16 at the bottom 180 of the enlarged interior portion 176. In each configuration, one or more spacers 172 fill the space above, below, left, and/or right of the T-shaped base portion 134 inside the enlarged interior portion 176, thereby supporting and securing the blade 16 at the desired height 130 in the radial direction 2 relative to the rotational axis 20.

Figure 16:
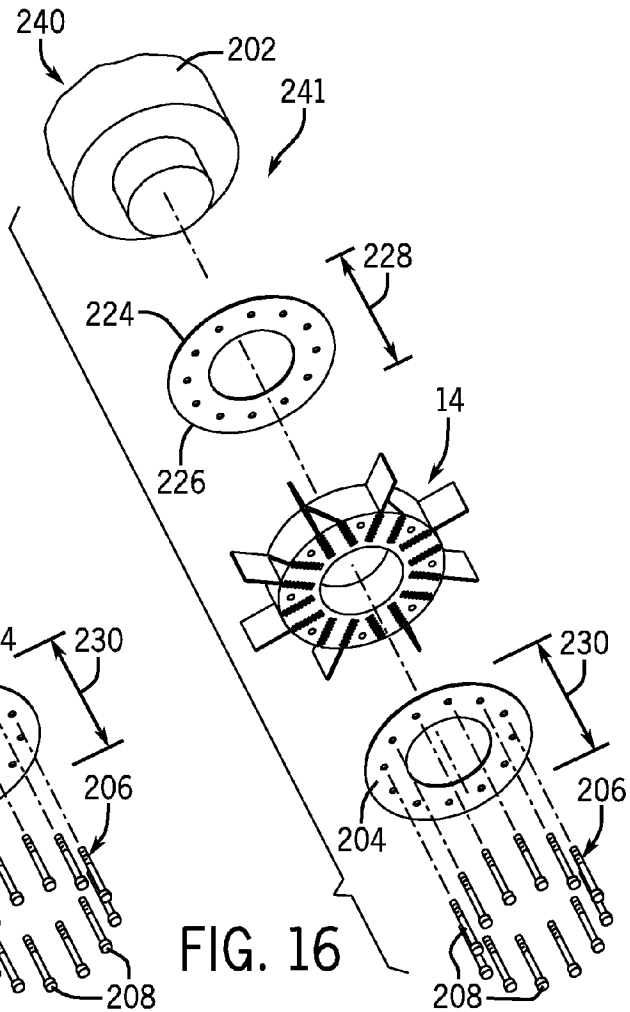
FIGS. 14-16 are exploded views of embodiments of fans with adjustable blades being coupled to a drive.
Figure 15:
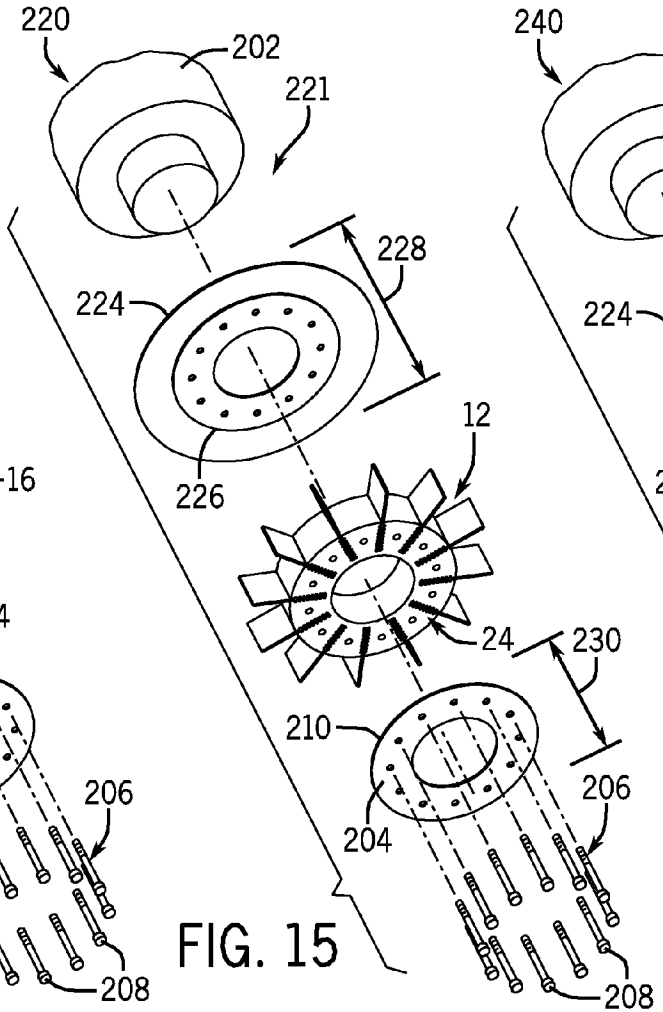
Figure 14:
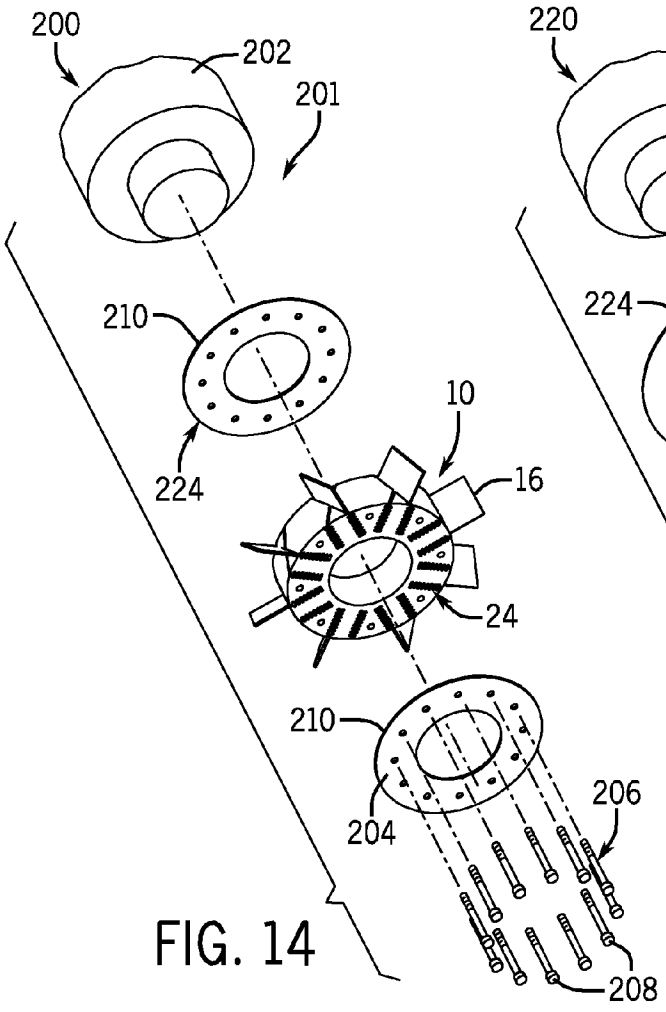

FIGS. 14-16 are exploded views of embodiments of fans with adjustable blades 16. FIG. 14 illustrates an embodiment of an axial fan 200 with a mounting system 201. The fan 200 includes a rotating machine 202, the bi-axial fan hub 10 with the adjustable blade mounting system 24, rotary blades 16 installed into the bi-axial fan hub 10, a front plate 204, a back plate 224, and a connection system 206. The bi-axial fan hub 10 installs onto rotating machine 202 via the connection system 206, which includes a plurality of threaded fasteners 208 that mate with corresponding threads on the rotating machine 202. The plates 204, 224 extend over the adjustable blade mounting system 24 to block entry of contaminants into the blade mounting system 24, e.g., variable orientation mounts 26. Furthermore, the plates 204, 224 may include a seal 210 (e.g., an annular seal) disposed circumferential about a perimeter of the plates 204, 224 thereby further blocking entry of contaminants into the blade mounting system 24. As discussed above, the blades 16 may be reoriented relative to the hub 10 by removing each blade 16, and then reinstalling each blade at a suitable height and/or angle. Accordingly, the front plate 204 may be removed to expose the variable orientation mounts 26 to enable the reconfiguration, followed by reattachment of the front plate 204 after the reconfiguration is complete.

FIG. 15 illustrates an embodiment of a radial fan 220 with a mounting system 221. The radial fan 220 includes the rotating machine 202, the radial fan hub 12 with the adjustable blade mounting system 24, the front plate 204, the back plate 224, and the connection system 206. Similar to the embodiment of FIG. 13, the radial fan hub 12 installs onto rotating machine 202 via the connection system 206, which includes the plurality of threaded fasteners 208 that mate with corresponding threads on the rotating machine 202. The plates 204, 224 extend over opposite front and rear sides of the adjustable blade mounting system 24 to block entry of contaminants into the blade mounting system 24, e.g., variable orientation mounts 26. As discussed above, the front plate 204 may include the seal 210 (e.g., an annular seal) to further block entry of contaminants into the blade mounting system 24. Likewise, the back plate 224 may include a seal 226 (e.g., an annular seal) to further block entry of contaminants into the blade mounting system 24. In the illustrated embodiment, the back plate 224 has a diameter 228 larger than a diameter 230 of the front plate 204. The enlarged back plate 224 may overlap the blades 16 to help guide the airflow in a radial direction 4. As discussed above, the blades 16 may be reoriented relative to the hub 12 by removing each blade 16, and then reinstalling each blade at a suitable height. Accordingly, the front cover 204 may be removed to expose the variable orientation mounts 26 to enable the reconfiguration, followed by reattachment of the front cover 204 after the reconfiguration is complete.

FIG. 16 illustrates an embodiment of an axial/radial fan 240 with a mounting system 241. The axial/radial fan 240 includes the rotating machine 202, the back plate 224, the axial/radial fan hub 14 with the adjustable blade mounting system 24, the front plate 204, and the connection system 206. Similar to the embodiment of FIG. 13, the axial/radial fan hub 14 installs onto rotating machine 202 via the connection system 206, which includes the plurality of threaded fasteners 208 that mate with corresponding threads on the rotating machine 202. The plates 204, 224 extend over opposite front and rear sides of the adjustable blade mounting system 24 to block entry of contaminants into the blade mounting system 24, e.g., variable orientation mounts 26. As discussed above, the plates 204, 224 may include seals 210, 226 (e.g., annular seals) to further block entry of contaminants into the blade mounting system 24. In the illustrated embodiment, the diameter 228 of the back plate 224 is substantially the same as the diameter 230 of the front plate 204. In particular, the diameter 228 is reduced relative to the embodiment of FIG. 15 to enable operation of the fan 240 as an axial flow fan or a radial flow fan. However, the illustrated back plate 224 may be replaced with another back plate 224 having a larger diameter 228, such as illustrated in FIG. 15, to help guide the airflow in the radial direction 4 when the fan 240 is configured as a radial fan. As discussed above, the blades 16 may be reoriented relative to the hub 14 by removing each blade 16, and then reinstalling each blade at a suitable height and/or angle. Accordingly, the front cover 204 may be removed to expose the variable orientation mounts 26 to enable the reconfiguration, followed by reattachment of the front cover 204 after the reconfiguration is complete.

Technical effects of the invention include an adjustable fan that can be adapted to a multitude of applications. For example, the fan can be adapted to increase or decrease air flow or fan diameter by adjusting the height of the rotary fan blades. Additionally, the fan flow direction may be altered by adjusting the rotary blade angles. Indeed, in some embodiments, the flow direction may be altered to an opposite direction based upon the blade installation. Furthermore, in some embodiments the fan can be adapted to become either a radial or an axial fan.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a fan, comprising:

a plurality of rotary blades;

a rotary hub comprising a plurality of variable orientation mounts, wherein each of the variable orientation mounts is configured to independently support one of the plurality of rotary blades in a plurality of orientations relative to a rotational axis of the fan; and wherein the plurality of orientations comprises a plurality of blade heights relative to the rotational axis.

2. The system of claim 1, wherein the plurality of orientations comprises a plurality of blade angles relative to the rotational axis.

3. The system of claim 1, wherein the variable orientation mount comprises a first mounting slot and a second mounting slot in the rotary hub, the first and second mounting slots are angled different from one another.

4. The system of claim 3, wherein the first mounting slot is parallel to the rotational axis, and the second mounting slot is non-parallel to the rotational axis.

5. The system of claim 3, wherein the first and second mounting slots are both non-parallel to the rotational axis.

6. The system of claim 5, wherein the first and second mounting slots intersect one another in an X-shaped configuration.

7. The system of claim 5, wherein the first and second mounting slots intersect one another in a V-shaped configuration.

8. The system of claim 3, wherein the rotary blade comprises a blade portion extending from a T-shaped base portion, the first mounting slot comprises a first height adjustment feature to selectively support the T-shaped base portion at a first plurality of heights, and the second mounting slot comprises a second height adjustment feature to selectively support the T-shaped base portion at a second plurality of heights.

9. The system of claim 1, wherein the variable orientation mount comprises a mounting slot extending into the rotary hub, the mounting slot comprises a plurality of lateral grooves at different heights relative to the rotational axis, and the rotary blade comprises a blade portion extending into the mounting slot and a lateral lip portion selectively extending into one of the plurality of lateral grooves.

10. The system of claim 1, wherein the variable orientation mount comprises a mounting slot extending into the rotary hub, the mounting slot comprises an opening portion and an enlarged interior portion, the rotary blade comprises a blade portion extending into the mounting slot through the opening portion, and the rotary blade comprises a lateral lip portion selectively secured at a plurality of heights via one or more spacing blocks disposed in the enlarged interior portion.

11. The system of claim 1, comprising an adjustable blade mounting system having a plurality of variable orientation mounts supporting a plurality of rotary blades about a circumference of the rotary hub, wherein each mount of the plurality of variable orientation mounts is configured to support a respective rotary blade in a plurality of heights or a plurality of angles.

12. A system, comprising:

a fan hub comprising an adjustable blade mounting system having a plurality of variable orientation mounts configured to support a plurality of rotary blades about a circumference of the fan hub, wherein each mount of the plurality of variable orientation mounts is configured to support a respective rotary blade in a plurality of heights and a plurality of angles.

13. The system of claim 12, wherein each mount of the plurality of variable orientation mounts is configured to support the respective rotary blade in the plurality of heights.

14. The system of claim 12, wherein each mount of the plurality of variable orientation mounts is configured to support the respective rotary blade in the plurality of angles.

15. The system of claim 14, wherein the plurality of angles comprise a first angle and a second angle, the first angle is oriented to direct a flow in a first axial direction, and the second angle is oriented to direct the flow in a second axial direction opposite from the first axial direction.

16. The system of claim 14, wherein the plurality of angles comprise a first angle and a second angle, the first angle is oriented to direct a flow in an axial direction, and the second angle is oriented to direct the flow in a radial direction.

* * * * *